US010081943B2

(12) United States Patent
Saiki et al.

(10) Patent No.: US 10,081,943 B2
(45) Date of Patent: Sep. 25, 2018

(54) PREGROUTED PC STEEL MATERIAL AND METHOD FOR HARDENING PREGROUT LAYER THEREOF

(71) Applicants: Sumitomo (SEI) Steel Wire Corp., Itami-shi (JP); Sumitomo Electric Industries, Ltd., Osaka-shi (JP)

(72) Inventors: Takahide Saiki, Itami (JP); Masato Yamada, Itami (JP); Yoshihiko Touda, Itami (JP); Takashi Ichiki, Itami (JP); Kiminori Matsushita, Itami (JP); Katsuhito Oshima, Itami (JP); Jun Sugawara, Osaka (JP); Shingo Nakajima, Osaka (JP); Shuhei Maeda, Osaka (JP)

(73) Assignees: Sumitomo (SEI) Steel Wire Corp., Itami-shi (JP); Sumitomo Electric Industries, Ltd., Osaka-shi (JP)

( * ) Notice: Subject to any disclaimer, the term of this patent is extended or adjusted under 35 U.S.C. 154(b) by 701 days.

(21) Appl. No.: 14/418,885

(22) PCT Filed: Jul. 5, 2013

(86) PCT No.: PCT/JP2013/068495
§ 371 (c)(1),
(2) Date: Jan. 30, 2015

(87) PCT Pub. No.: WO2014/021056
PCT Pub. Date: Feb. 6, 2014

(65) Prior Publication Data

US 2015/0159377 A1 Jun. 11, 2015

(30) Foreign Application Priority Data

Jul. 31, 2012 (JP) ..... 2012-169376

(51) Int. Cl.
*E04C 5/08* (2006.01)
*E04G 21/12* (2006.01)
*E04C 5/10* (2006.01)

(52) U.S. Cl.
CPC ..... *E04C 5/08* (2013.01); *E04G 21/12* (2013.01); *E04C 5/10* (2013.01); *Y10T 428/31529* (2015.04); *Y10T 428/31678* (2015.04)

(58) Field of Classification Search
CPC ..... E04G 5/08; E04G 21/12
See application file for complete search history.

(56) References Cited

U.S. PATENT DOCUMENTS 4,631,883 A * 12/1986 Harris ..... E04C 5/10 52/223.14
4,849,282 A 7/1989 Watanabe et al.
5,208,077 A * 5/1993 Proctor ..... B05D 7/20 118/634

FOREIGN PATENT DOCUMENTS

EP 0198398 A2 10/1986
JP S61233149 A 10/1986
(Continued)

OTHER PUBLICATIONS

International Search Report in PCT International Application No. PCT/JP2013/068495 dated Aug. 27, 2013.
(Continued)

*Primary Examiner* — Joseph S Del Sole
*Assistant Examiner* — John Robitaille
(74) *Attorney, Agent, or Firm* — Venable LLP; Michael A. Sartori; Laura G. Remus

(57) ABSTRACT

Provided is a pregrouted PC steel material comprising a PC steel stranded wire composed of a plurality of steel wires, a pregrout layer disposed on the outer periphery of the PC steel stranded wire so as to accommodate the PC steel
(Continued)

stranded wire, a sheath covering the outer periphery of the pregrout layer, and a capsule including a pregrout-hardening agent and a film with which the agent is covered, the capsule being interposed among the steel wires constituting the PC steel stranded wire. The capsule has a strength such that the capsule is not broken before tensioning the PC steel stranded wire but is broken by a tensile force during the tensioning. Also provided is a method for hardening the pregrout layer.

6 Claims, 2 Drawing Sheets

(56) References Cited

FOREIGN PATENT DOCUMENTS

| | | | |
|---|---|---|---|
| JP | 05-038818 | | 6/1993 |
| JP | 05-200825 | | 8/1993 |
| JP | 2000-281967 | | 10/2000 |
| JP | 2003-172001 | | 6/2003 |
| JP | 2005-171581 | A | 6/2005 |
| JP | 3786599 | B2 | 6/2006 |
| JP | 2007-211486 | | 8/2007 |
| JP | 2009-108497 | | 5/2009 |
| JP | 2012-117243 | | 6/2012 |
| WO | WO-2009/054489 | A1 | 4/2009 |

OTHER PUBLICATIONS

Extended European Search Report in European Patent Application No. 13826257.1, dated Mar. 14, 2016.

Notification of the First Office Action in Chinese Patent Application No. 2013800401640, dated Sep. 25, 2015.

* cited by examiner

PREGROUTED PC STEEL MATERIAL AND METHOD FOR HARDENING PREGROUT LAYER THEREOF

TECHNICAL FIELD

The present invention relates to a pregrouted PC (Prestressed Concrete) steel material used in a PC construction method, such as PC post-tensioning construction, and a method for hardening a pregrout layer of the pregrouted PC steel material.

BACKGROUND ART

Typical post-tensioning construction is a construction method tier inserting a PC steel material into a cylindrical sheath previously embedded in concrete, and tensioning and fixing the PC steel material to provide the concrete with compressive stress by a reaction force of the tensile force, which compensates for a drawback of concrete in that the tensile strength is weak.

In this post-tensioning construction, a grout material, such as cement milk, is injected or mixed between the sheath and the PC steel material to achieve adhesion between the PC steel material and concrete, and to prevent corrosion of the PC steel material.

The operation of injecting the grout material is troublesome because it is performed in a construction site, and results in cost increase. Therefore, a pregrouted PC steel material previously provided with a sheath, a PC steel material and a grout material is in use. The pregrouted PC steel material has a PC steel stranded wire in which a plurality of steel wires (element wires) are stranded together, a pregrout layer disposed on the outer periphery of the PC steel stranded wire so as to accommodate the PC steel stranded wire, and a sheath covering the outer periphery of the pregrout layer (see Japanese Patent Laying-Open No 2003-172001 (PTD 1), paragraph 0005 and FIG. 2; Japanese Patent Laying-Open No 2007-211486 (PTD 2), paragraph 0017 and FIG. 1).

It is noted that, throughout the present specification a grout material used for a pregrouted PC steel material and a grout layer (a layer composed of the grout material) of the pregrouted PC steel material will be referred to as a pregrout material and a pregrout layer, respectively.

In the post-tensioning construction in which the pregrouted PC steel material is used, it is required that the pregrout material (pregrout layer) be not hardened until a PC steel stranded wire is tensioned (have a long pot life) and be hardened at ordinary temperature after the PC steel stranded wire is tensioned and fixed to concrete. As pregrout materials that may satisfy such required characteristics, various pregrout materials which are hardened within a predetermined period have been proposed.

For example, the above-described PTD 1 and Japanese Patent Laying-Open No. 2000-281967 (PTD 3) each propose a pregrout material having a predetermined number of days required for hardening, a predetermined composition and viscosity (claim 1 of each Patent Document). The number of days required for hardening is controlled by adjustment of the blending amount of a hardening agent that hardens the pregrout material.

On the other hand, Japanese Patent Laying-Open No. 2009-108497 (PTD 4) proposes a pregrout material composed of a thermoplastic resin composition. This pregrout material is softened by heating and is solidified by being left to cool.

CITATION LIST

Patent Document

PTD 1: Japanese Patent Laying-Open No. 2003-172001
PTD 2: Japanese Patent Laying-Open No. 2007-211486
PTD 3: Japanese Patent Laying-Open No. 2000-281967
PTD 4: Japanese Patent Laying-Open No. 2009-108497

SUMMARY OF INVENTION

Technical Problem

The degree of progress in hardening of a pregrout layer in a pregrouted PC steel material in which the pregrout layer is hardened with a hardening agent varies depending on the environment, such as atmospheric temperature. Construction cannot be completed within a scheduled construction period in many cases. In the case where the construction period is prolonged, hardening of the pregrout material may progress to affect the tensioning operation of the PC steel stranded wire.

From such actual circumstances, the longest possible tensionable period is often required. Therefore, a pregrout material (such as resin) constituting the pregrout layer currently applied is mix designed so as to extend the pot life. However, since there is a trade-off between the pot life and the hardening time (the time required for complete hardening), several years are usually required before the pregrout layer is completely hardened.

On the other hand, the above-described PTD 2 proposes, as means for hardening a pregrout layer at any time, providing a heating element in a sheath and applying electric current to the heating element to thereby promote hardening of the pregrout layer. It is, however, necessary to apply electric current to the heating element after tensioning the PC steel stranded wire, which makes the operation troublesome.

In view of the above-described actual circumstances, the present invention has an object to provide a pregrouted PC steel material in which hardening of a pregrout layer may be started by means other than heating at the start time when promotion of hardening is desired, and a method for hardening the pregrout layer.

Solution to Problem

The start time when promotion of hardening of the above-described pregrout layer is desired is the time when prestress is applied to concrete after finishing placing the concrete, that is, the time when a PC steel stranded wire is tensioned and fixed to provide the concrete with compressive stress by a reaction force of the tensile force. Therefore, in order to achieve the above-described object, the present invention enables hardening of the pregrout layer to be promoted when providing concrete with compressive stress by a reaction force of the tensile force.

To enable hardening of the pregrout layer to be promoted when applying prestress a pregrouted PC steel material of the present invention includes a hardening agent-containing capsule (hereinafter also referred to as a "capsule") to be interposed among steel wires constituting the PC steel stranded wire. This capsule is composed of a pregrout-hardening agent (which is a hardening agent for hardening the pregrout material, and hereinafter also referred to as a "hardening agent") and a film with which the agent is covered. This capsule is configured such that its film is not broken until the PC steel stranded wire is tensioned but is broken by narrowing the air gap among the steel wires constituting the PC steel stranded wire during tensioning and fixing, for example. That is, breakage of the film allows the hardening agent therein to exude to harden the pregrout layer.

According to the pregrouted PC steel material of the above-described configuration, the hardening agent will not flow out to the pregrout layer until the PC steel stranded wire is tensioned. Therefore, any inconvenience will not be imposed on the operation of tensioning and fixing the PC steel stranded wire by hardening of the pregrout layer. On the other hand, when the PC steel stranded wire is tensioned, the gap among the respective steel wires will be narrowed. With this narrowing of the gap, compressive and shearing forces are exerted on the capsule present therein to break the film. On this occasion, the hardening agent in the capsule flows out (exudes) to the pregrout layer for the first time, which promotes hardening of the pregrout layer. That is, the start time when hardening of the pregrout layer is promoted is the time when the PC steel stranded wire is tensioned and fixed to provide concrete with compressive stress after finishing placing the concrete (when applying prestress to the concrete).

It is noted that the above-described PTD 1 presents in paragraph 0022 the idea of adding a microcapsule in which a hardening agent is covered with a film, to a pregrout layer. However, PTD 1 makes no mention of interposing this microcapsule among steel wires or breaking the microcapsule by a tensile force of the PC steel stranded wire. It is recognized that the microcapsule described in PTD 1 is broken when the film is dissolved with water or the like in the pregrout layer or melted by heating to allow the hardening agent therein to flow out to the pregrout layer. That is, there is no idea of breaking the film of the capsule by the tensile force of the PC steel stranded wire, and in order to harden the pregrout layer completely by the action of water or the like, three years or more be required as described above.

A specific configuration of the pregrouted PC steel material according to the present invention will be described now. The pregrouted PC steel material of the present invention includes a PC steel stranded wire in which a plurality of steel wires are stranded, a pregrout layer disposed on the outer periphery of the PC steel stranded wire so as to accommodate the PC steel stranded wire, a sheath covering the outer periphery of the pregrout layer, and a capsule including a pregrout-hardening agent and a film with which this agent is covered, the capsule being interposed among the steel wires constituting the PC steel stranded wire. The capsule has a strength such that the capsule is not broken before tensioning the PC steel stranded wire but is broken by a tensile force during the tensioning.

Herein, the phrase "the capsule is not broken before tensioning the PC steel stranded wire" does not only necessarily refer to the case where it is not broken at all, but also includes the case where it is broken to such an extent that there is no inconvenience in construction in the process from manufacturing of the PC steel stranded wire to construction thereof. The phrase "a strength such that the capsule is broken by a tensile force of the PC steel stranded wire" not only includes the case where all capsules are broken, but also includes the case where some capsules are broken to allow the hardening agent to flow out of the capsules by an amount enough to harden the pregrout layer.

The capsule is placed in the gap between the steel wires and is broken (the film is broken) by narrowing of the gap during the tensioning of the PC steel stranded wire, and may have various shapes, such as a spherical, elliptical or egg-like shape. As the capsule becomes larger, it is more likely to be broken. Therefore, the capsule is preferably as large as possible (having a large diameter) as long as it is not broken when tension is not applied thereto, however, the size thereof can be set suitably as long as the effects of the present invention may be exhibited.

The tensile force of the PC steel stranded wire is set suitably depending on the properties of placed concrete or the like. Therefore, the film of the capsule preferably has a strength of such a value that the capsule is not broken before tensioning the PC steel stranded wire but is broken by the tensile force, in accordance with the set value of the tensile force. In the case where such setting is troublesome, however, the strength of the film of the capsule may be set based on the highest tensile force obtained from conventional experiences.

The compressive breaking strength of the capsule is preferably more than or equal to 3N. If the compressive breaking strength is less than 3N, the capsule may be broken in the operation before the tensioning operation, that is, during a manufacturing step, such as the step of adding the capsule or the step of taking up the PC steel stranded wire, or during handling after manufacturing, such as transportation of the PC steel stranded wire. The compressive breaking strength of the capsule is more preferably more than or equal to 5N, and still more preferably more than or equal to 10N.

The compressive breaking strength of the capsule is preferably less than or equal to 500N, more preferably less than or equal to 300N, and still more preferably less than or equal to 150N. If the compressive breaking strength exceeds 500N, the capsule may not be broken even by a common tensile force of the PC steel stranded wire. The optimum value of the compressive breaking strength of the capsule such that the capsule is not broken before tensioning the PC steel stranded wire but is broken by the tensile force during the tensioning varies depending on the position where the capsule is to be disposed in the gap left among the steel wires constituting the PC steel stranded wire. Therefore, the compressive breaking strength of the capsule is set appropriately in consideration of this point.

The compressive breaking strength of the capsule is measured with an autograph (e.g., "Autograph AG-1S" available from Shimadzu Corporation) as a stress when the capsule is broken on the condition that the compression rate is 1 mm/min.

The heat-resistant temperature of the film of the capsule is preferably more than or equal to 50° C. If the heat resistance of the film is low, the film may be broken under the influence of heat generation of concrete after placing the concrete. The temperature is preferably more than or equal to 60° C., and more preferably more than or equal to 70° C. The heat-resistant temperature is measured as described below. After immersing 20 parts by weight of capsules in 100 parts by weight of an epoxy resin (Bisphenol A liquid epoxy resin available from Mitsubishi Chemical Corporation under the trade name "jER828") and leaving it at rest at a temperature of X ° C. for 12 hours, the viscosity Unite epoxy resin is measured. The highest value of the temperature of X ° C. when the viscosity after leaving at rest for 12 hours is less than or equal to 150% of the initial viscosity before adding the capsule is defined as the heat-resistant temperature of the capsule.

Since the hardening agent enclosed in the capsule does not leak out until the film is broken, a hardening agent having a high hardening rate can be selected suitably. When the hardening agent having a high hardening rate is used, the hardening time of the pregrout layer can be accelerated.

As the hardening agent, a hardening agent for epoxy resin and/or a hardening accelerator for epoxy resin represented by the mixture of aliphatic polyamine and imidazole or the like, ketimine which reacts with water to produce amine, or the like can be used.

The material of the film of the capsule can be selected suitably depending on the type of hardening agent to be enclosed. For example, a polymeric material, such as gelatin/a urethane acrylate, can be used. A cut groove (half cut) can be made on the surface of the film so that the film can be easily broken by a shearing force when the PC steel stranded wire is tensioned.

A capsule of a three-layered structure having a two-layer film can also be used. For example, by using, for the inner film, a material having high stability with respect to the hardening agent to be enclosed and using, for the outer film, a material having high stability with respect to the binder (such as an epoxy resin), the hardening agent can be prevented from exuding to the outside of the capsule at an unintended time or the epoxy resin serving as a binder can be prevented from permeating into the capsule. Thus, the pot life of the capsule can be made very long, and a sufficient tensionable period can be ensured.

The pregrout layer (pregrout material) preferably contains a hardenable resin which is hardened by the above-described hardening agent. Examples of the hardenable resin can include an epoxy resin. The hardenable resin may be of the same material as or a different material from the binder of the capsule.

Prestress introduction into concrete by the pregrouted PC steel material of the present invention is implemented by previously embedding the pregrouted PC steel material in the concrete, and after finishing placing the concrete, tensioning and fixing the PC steel stranded wire, similarly to conventional cases.

On this occasion, the film of the capsule is broken by a tensile force during the tensioning of the PC steel stranded wire, and the hardening agent therein exudes to the pregrout layer to harden the pregrout layer.

Advantageous Effects of Invention

According to the present invention, outflow of the hardening agent into the pregrout layer can be started to advance hardening of the pregrout layer at the time when the PC steel stranded wire is tensioned and fixed to provide concrete with compressive stress, that is, at the start time when promotion of hardening of the pregrout layer is desired. Shortening of the construction period can thereby be achieved without imposing any inconvenience on the operation of tensioning and fixing the PC steel stranded wire.

DESCRIPTION OF EMBODIMENTS

Figure 1:
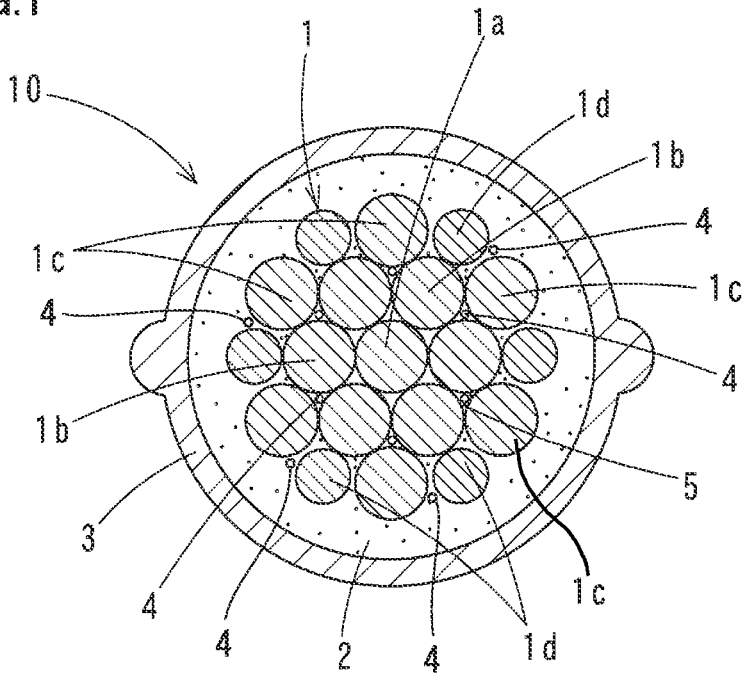
FIG. 1 is a cross sectional view showing an embodiment of a pregrouted PC steel material according to the present invention.

FIG. 1 is a cross-sectional view (a cross-sectional view in a direction perpendicular to the longitudinal direction) showing an embodiment of a pregrouted PC steel material in accordance with the present invention. As with conventionally known pregrouted PC steel materials, a pregrouted PC steel material 10 shown in FIG. 1 includes a PC steel stranded wire 1 with a multi-layered structure in which a plurality of steel wires 1*a*, 1*b*, 1*c*, and 1*d* composed of a piano wire or the like are stranded together, a pregrout layer 2 composed of an epoxy resin (a pregrout material) and disposed on the outer periphery of PC steel stranded wire 1 so as to accommodate PC steel stranded wire 1, and a sheath 3 composed of polyethylene and covering the outer periphery of pregrout layer 2. In the present embodiment, the diameter of each of steel wires 1*a*, 1*b* and 1*c* is set at 6.1 to 6.7 mm, the diameter of steel wire 1*d* is set at approximately 5 mm, the diameter of PC steel stranded wire 1 is set at 28.6 mm, and the thickness of sheath 3 is set at approximately 1.5 mm. PC steel stranded wire 1 is composed of a total of 19 steel wires 1*a*, 1*b*, 1*c*, and *d*.

Figure 2:
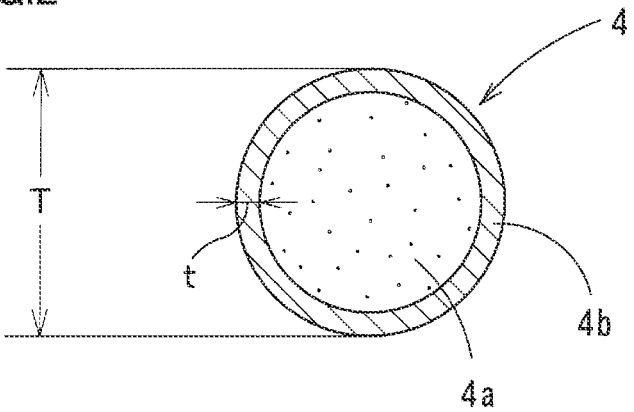
FIG. 2 is an enlarged cross sectional view showing a capsule contained in the pregrouted PC steel material shown in FIG. 1.

A capsule 4 as shown in FIG. 2 is interposed among the steel wires constituting PC steel stranded wire 1. Capsule 4 has a structure in which a hardening agent 4*a* is covered with a film 4*b*. Capsule 4 is a capsule in which hardening agent 4*a* including an aliphatic polyamine and an imidazole is covered with film 4*b* composed of gelatin/a urethane acrylate. In the present embodiment, an average particle diameter T of capsule 4 is set at 1.5 mm, and an average thickness t of film 4*b* is set at 65 μm.

Pregrouted PC steel material 10 can be manufactured by the following method. First, 6 lateral wires (inner layer steel wires) 1*b* as an inner layer are stranded on the periphery of core wire (steel wire) 1*a*, and 6 lateral wires (outer layer steel wires) 1*c* and 6 lateral wires (outer layer steel wires) 1*d* as an outer layer are stranded on the periphery of the inner layer to obtain a stranded wire. After or at the same time when the stranded wire is subjected to a stretching treatment, it is subjected to a bluing treatment to stabilize the stranded state.

Then, while the strand of the our layer (lateral wires 1*c* and 1*d*) of the stranded wire is partially and sequentially loosened to open, a stranded wire composed of core wire 1*a* and the inner layer (lateral wires 1*b*) is passed through a reservoir accommodating a kneaded material of capsule 4 and a hinder 5 composed of an epoxy resin or the like.

The periphery of the inner layer (lateral wires 1*b*) is covered with the kneaded material of capsule 4 and binder 5 (capsule 4-containing binder 5) by the passage through the reservoir accommodating the kneaded material.

Figure 3:
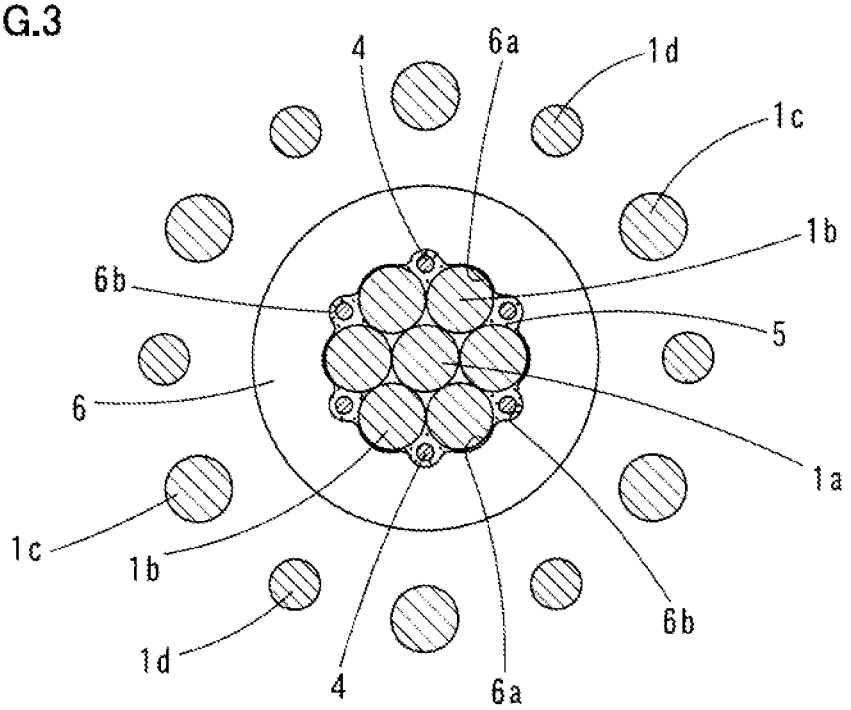
FIG. 3 is a cross sectional view showing the step of threading a stranded wire composed of a core wire and lateral wires of an inner layer through an opening of a die.

Thereafter, as depicted in FIG. 3, the stranded wire composed of core wire 1*a* and the inner layer (lateral wires 1*b*) is threaded through a prescribed shaped opening of a die 6 so as to remove the kneaded material of capsule 4 and binder 5 that has existed on a part of the outer periphery of the inner layer (lateral wires 1*b*) and to have the kneaded material of capsule 4 and binder 5 interposed among respective lateral wires 1*b* of the inner layer. This allows capsule 4 to be disposed among respective lateral wires 1*b*, which provides an advantage that capsule 4 will not be crushed when lateral wires le and id of the our layer are re-stranded.

The inner peripheral surface of the opening of die 6 has such a shape that circular arc-shaped surfaces 6*a* for guiding lateral wires 1*b* and circular arc-shaped surfaces 6*b* for guiding the kneaded material of capsule 4 and binder 5 to gaps among respective lateral wires 1*b* at the outer periphery of the inner layer are alternately arranged. Thus, threading the stranded wire through the opening allows the kneaded material of capsule 4 and binder 5 to be smoothly disposed among respective lateral wires 1*b*. Circular arc-shaped surfaces 6*b* have a smaller curvature radius than circular arc-shaped surfaces 6*a*. For instance, the curvature radius of circular arc-shaped surfaces 6*b* may be approximately half of that of circular arc-shaped surfaces 6*a* (for instance, the curvature radii of circular arc-shaped surfaces 6*a* and 6*b* may be 3.08 mm and 1.5 mm, respectively).

The number of capsules 4 to be interposed among lateral wires 1*b* suitably set, based on the number such that breaking of capsule 4 does not occur in a subsequent step, namely when lateral wires 1*c* and 1*d* of the our layer are re-stranded, which can be identified by experiments in advance. The setting of the number of capsules 4 is performed by adjustment of the size of capsule 4, the concentration of capsules 4 in binder 5 or so on.

After disposing the kneaded material of capsule 4 and binder 5 on a part of the outer periphery of the inner layer (lateral wires 1*b*) as described above, loosening of the above-described outer layer (lateral wires 1*c* and 1*d*) is stopped, and the outer layer (lateral wires 1*c* and 1*d*) is re-stranded around the inner layer (lateral wires 1*b*). By this re-stranding, part of the kneaded material placed on the outer periphery of the inner layer (lateral wires 1*b*) is usually moved to the gaps among lateral wires 1*c* and 1*d* of the outer layer. Therefore, capsule 4 is usually interposed also among lateral wires 1*c* and 1*d* of the outer layer. Means (untwisting means) as described above for partially and sequentially loosening the strand of the outer layer of the stranded wire to open while covering the stranded wire composed of core wire 1*a* and lateral wires 1*b* with resin is well known itself (e.g., Japanese Patent Laying-Open No. 05-200825, paragraphs 0012 to 0034, and FIGS. 1 to 10).

Finally, pregrout layer 2 is disposed by a conventionally known method on the outer periphery of PC steel stranded wire 1 with the kneaded material of capsule 4 and binder 5 interposed between the inner and outer layers (lateral wires 1*b*, 1*c* and 1*d*), and sheath 3 is formed therearound by extrusion molding to obtain pregrouted PC steel material 10 shown in FIG. 1.

Pregrouted PC steel material 10 can be used in post-tensioning construction in a similar manner to conventional pregrouted PC steel materials. If PC steel stranded wire 1 of pregrouted PC steel material 10 is tensioned and fixed after placing and hardening concrete, compressive stress can be provided for the concrete by a reaction force of the tensile force.

When a tensile force of 500 to 700 kN was applied to PC steel stranded wire 1 of pregrouted PC steel material 10 of the present embodiment, film 4*b* of capsule 4 was broken, and hardening agent 4*a* therein flowed out to pregrout layer 2 (hardening agent 4*a* was added to pregrout layer 2). With such outflow of hardening agent 4*a*, complete hardening of pregrout layer 2 could be achieved in about a half period as compared with the conventional method for flowing hardening agent 4*a* by breaking film 4*b* by dissolution with water or the like.

When pregrouted PC steel material 10 was subjected to a bending test (with a radius of curvature of 1.0 m and held for 30 seconds) assuming the state of pregrouted PC steel material 10 wound around a drum, breakage of capsule 4 was not recognized.

Figure 4:
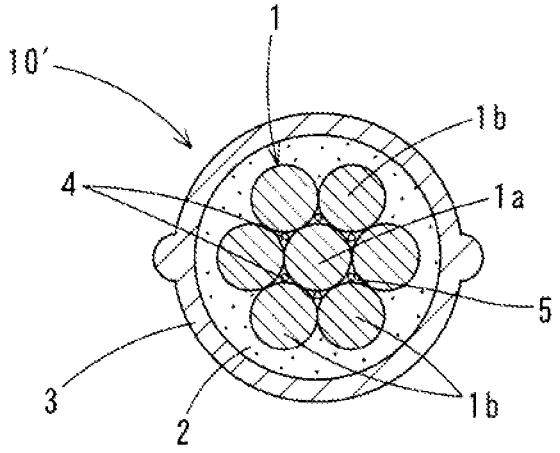
FIG. 4 is a cross sectional view showing another embodiment of the pregrouted PC steel material according to the present invention.

In the present invention, capsule 4 and binder 5 can also be interposed between core wire 1*a* and lateral wires 1*b* of the inner layer as in the embodiment shown in FIG. 4, for example. In this case, during manufacturing thereof, lateral wires (inner layer) 1*b* will also be untwisted. In the case where capsule 4 and binder 5 are also to be interposed between core wire 1*a* and lateral wires 1*b* of the inner layer in the embodiment shown in FIG. 1, capsule 4 and binder 5 may or may not be interposed between the inner layer (lateral wires 1*b*) and the outer layer (lateral wires 1*c*).

It is needless to say that the present invention is also applicable to a 7-strand pregrouted PC steel material 10' in which six lateral wires 1*b* are stranded together around core wire 1*a* as shown in FIG. 4. It is also needless to say that capsule 4 may also be added to pregrout layer 2 in the embodiments shown in FIGS. 4 and 1.

In the case where capsule 4 is added to pregrout layer 2, needle-like fillers (fibers) can be added to pregrout layer 2 for the purpose of promoting breakage of film 4*b* to achieve more smooth breakage of film 4*b*. The needle-like tillers can also be present in binder 5 among core wire 1*a* and lateral wires 1*b* and among lateral wires 1*b*, 1*c* and 1*d*.

Although the amount of the kneaded material of capsule 4 and binder 5 interposed between lateral wires 1*b* and 1*b* is controlled by die 6 in the above-described embodiment, capsule 4 and the like can cover (can be interposed among) lateral wires 1*b* and the like merely by passage through the reservoir accommodating the kneaded material, namely, merely by dipping, as long as breakage of capsule 4 is permitted.

The present invention does not eliminate an embodiment in which a conventional hardening agent has been blended in pregrout layer 2. It is needless to say that, when PC steel stranded wire 1 is tensioned, when a certain degree of viscosity is required of pregrout layer 2, and the like, it is necessary to suitably blend a hardening agent not covered with a film or an encapsulated hardening agent covered with a film but the film is dissolved with water or the like to obtain the hardening effect. It is needless to say that, in such cases, a required amount of the hardening agent should be blended in pregrout layer 2 beforehand. That is, the present invention is intended to promote hardening of pregrout layer 2 by breaking the capsules by a tensile force during the tensioning of PC steel stranded wire 1, as described above.

It is needless to say that conventionally well-known materials other than an epoxy resin can be employed suitably for the pregrout material and binder 5, and that hardening agent 4*a* in accordance with the pregrout material is employed.

It should be understood that the embodiments disclosed herein are illustrative and non-restrictive in every respect. The scope of the present invention is defined by the claims not by the description above, and is intended to include any modification within the meaning and scope equivalent to the terms of the claims.

REFERENCE SIGNS LIST

1 PC steel stranded wire; 1*a* core wire (steel wire); 1*b* lateral wire of inner layer (steel wire); 1*c* lateral wire (steel wire) of outer layer; 2 pregrout layer; 3 sheath; 4 capsule; 4*a* hardening agent (pregrout-hardening agent); 4*b* film; 5 binder (epoxy resin); 6 die; 6*a*, 6*b* circular arc-shaped surface; 10, 10' pregrouted PC steel material.

The invention claimed is:

1. A pregrouted PC steel material comprising:

a PC steel stranded wire composed of a plurality of steel wires;

a pregrout layer disposed on an outer periphery of said PC steel stranded wire so as to accommodate said PC steel stranded wire;

a sheath covering an outer periphery of said pregrout layer; and a capsule including a pregrout-hardening agent and a film with which said pregrout-hardening agent is covered, said capsule being interposed among said steel wires constituting said PC steel stranded wire, said capsule having a strength such that said capsule is not broken before tensioning said PC steel stranded wire but is broken by compressive and shearing forces exerted on the capsule present in a gap among said steel wires with a narrowing of the gap during the tensioning, wherein said capsule and a binder are interposed among said steel wires constituting said PC steel stranded wire, and said binder includes a hardenable resin.

2. The pregrouted PC steel material according to claim 1, wherein said binder includes an epoxy resin.

3. A method for hardening the pregrout layer of the pregrouted PC steel material as defined in claim 1, comprising the steps of:

embedding said pregrouted PC steel material in concrete; and tensioning said PC steel stranded wire to provide said concrete with compressive stress and breaking said film of said capsule by a tensile force during the tensioning to allow said pregrout-hardening agent to flow out to said pregrout layer.

4. The pregrouted PC steel material according to claim 1, wherein a compressive breaking strength of said capsule is more than or equal to 3N and less than or equal to 300N.

5. The pregrouted PC steel material according to claim 1, wherein a heat-resistant temperature of said film of said capsule is more than or equal to 50° C.

6. The pregrouted PC steel material according to claim 1, wherein a material of said film of said capsule is gelatin or urethane acrylate.

* * * * *